US005949893A

United States Patent [19]

Augustin

[11] Patent Number: 5,949,893

[45] Date of Patent: Sep. 7, 1999

[54] LOUDSPEAKER BOX

[76] Inventor: Heinz-Juergen Augustin, Billberger Strasse 8, D-39590 Storkau, Germany

[21] Appl. No.: 08/925,987

[22] Filed: Sep. 9, 1997

[30] Foreign Application Priority Data

Sep. 24, 1996 [DE] Germany ..... 196 39 159

[51] Int. Cl.[6] ..... H04R 25/00

[52] U.S. Cl. ..... 381/182; 381/160; 381/300; 181/155

[58] Field of Search ..... 381/24, 27, 88, 381/89, 90, 188, 205, 160, 182, 184, 300, 335, 332; 181/144, 145, 147, 155

[56] References Cited

U.S. PATENT DOCUMENTS 5,222,145 6/1993 Draffen ..... 381/24

5,307,418 4/1994 Sumitani ..... 381/24

5,321,756 6/1994 Patterson ..... 381/24

5,546,468 8/1996 Beard ..... 381/24

*Primary Examiner*—Minsun Oh Harvey

*Attorney, Agent, or Firm*—Karl Hormann

[57] ABSTRACT

A loudspeaker box for faithfully reproducing stereophonic sound. The box is divided into at least two chambers hermetically sealed from each other and provided with loudspeakers for propagating sound in directions substantially orthogonal of each other. The speakers may be alike or different and they may be controlled independently of each other in respect of their relative output volumes or frequencies.

7 Claims, 1 Drawing Sheet

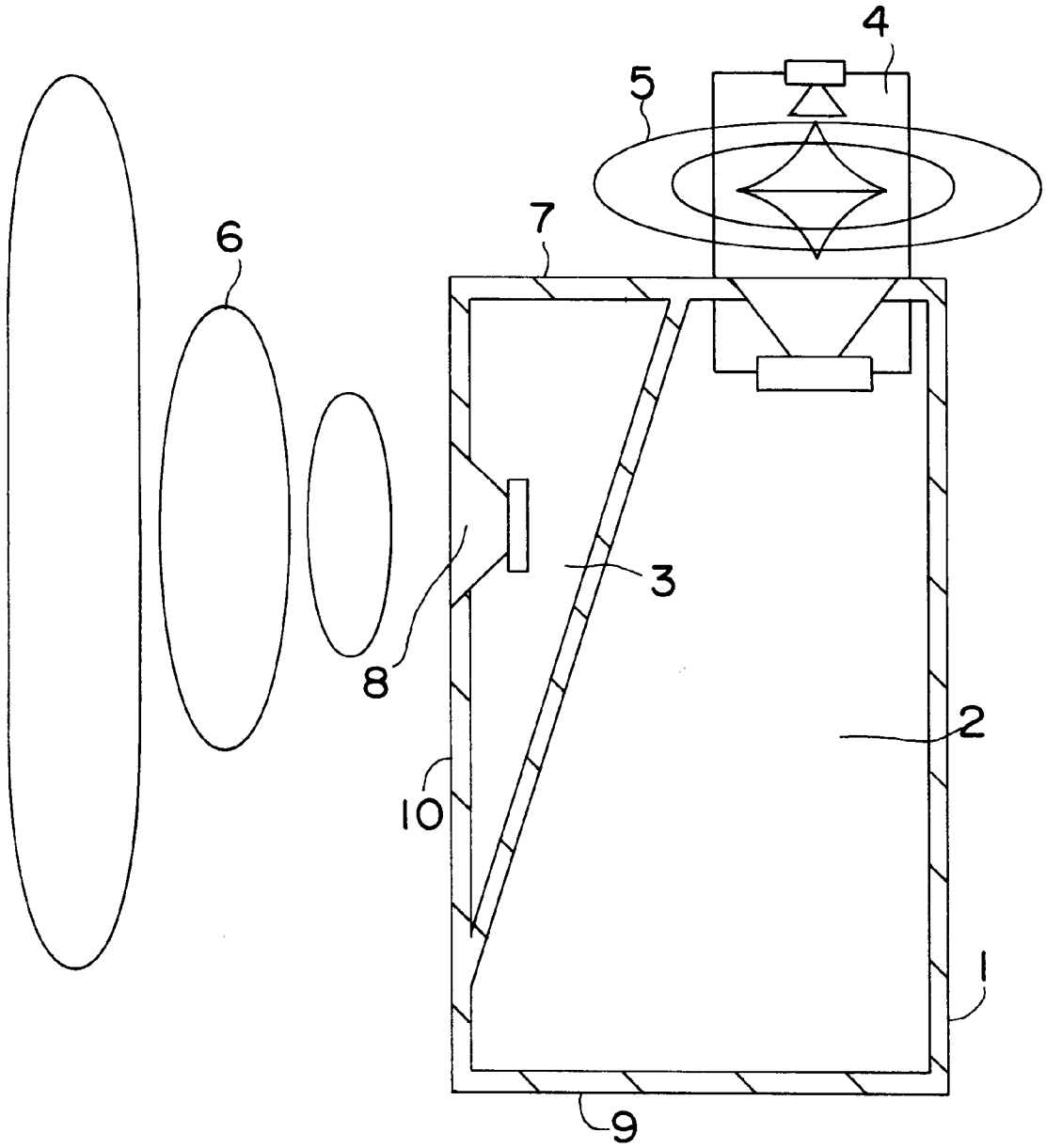
4
5
7
6
3
8
2
10
1
9

LOUDSPEAKER BOX

BACKGROUND OF THE INVENTION

1. Field of the Invention

The invention, in general, relates to a loudspeaker box and, more particularly, to a loudspeaker box useful for the creation of stereophonic sound.

2. The State of the Art

Loudspeaker boxes are well-known components of electronic entertainment centers as well as of announcement systems, and specifically for stereophonic sound emission.

Loudspeaker boxes are known in dual or multiple path systems for vertical frontal sound emission. Appropriately arranged or disposed, such loudspeaker boxes provide for excellent emission of sound transmitted by dual or multiple channel transmission systems.

One disadvantage of such loudspeaker boxes is that a listener has to place himself at a defined location within a predetermined direction of the sound lobe or lobes.

Loudspeaker boxes having horizontal sound emission characteristics are known, for instance, from German patent specification 4,331,959. Such boxes provide for a relatively uniform distribution of sound throughout a room, so that neither the listener nor the loudspeaker has to be located at a specific position. While providing for an overall generally favorable spatial sound effect, even with a single channel system, such speakers make it impossible in a dual-channel or stereophonic reproduction exactly to localize any particular sound between stereophonically operating loudspeaker boxes. Such localization is possible only of sound recorded with extremely one-sided or lateral effect.

OBJECTS OF THE INVENTION

It is a primary object of the invention to provide a loudspeaker box which in a dual-channel stereophonic operation is capable of reproducing stereophonic effects.

Another object of the invention is to provide a loudspeaker box in which the advantageous features of vertical and horizontal sound emission are combined.

Yet another object of the invention is to provide a audio system which with two loudspeaker boxes provides a stereophonic effect by direct sound as well as an undistorted spatial sound rendition.

It is also an object of the invention to provide a loudspeaker box by means of which reproduced sound resembles the sound recorded as closely as possible.

It is a still further object of the invention to provide a loudspeaker box for adjusting the emitted sound generated by a stereophonic transmission in accordance with the acoustic conditions of different spaces.

Another object of the invention is to provide a loudspeaker box adjustable to prevent any intensity-depending disturbances of the frequency patterns of stereophonic channels in an otherwise neutralized or quieted space.

Other objects will in part be obvious and will in part appear hereinafter.

BRIEF SUMMARY OF THE INVENTION.

In accordance with a preferred embodiment the invention provides a loudspeaker box having at least two hermetically sealed chambers, one of the chambers being located at the front of the speaker box and being provided with at least one frontal speaker propagating sound horizontally, and a second chamber which at at least one of its horizontal surfaces is provided with at least one horizontally propagating speaker diffusor combination. The inputs and outputs of the loudspeaker arranged in the first chamber and of the speaker diffusor combination provided in or at the second chamber may be controlled independently of each other. The signals within the loudspeaker box may actively or passively be proportionally distributed by conventional switching technology between the loudspeakers in the first chamber and in the second chamber.

In another embodiment, a plurality of hermetically sealed chambers provided with loudspeaker arrangements therein may be provided in the housing of the loudspeaker box in addition to the first and second chambers.

BRIEF DESCRIPTION OF THE DRAWING

The novel features which are considered to be characteristic of the invention are set forth with particularity in the appended claims. The invention it self, however, in respect of its structure, construction, lay-out and design, as well as manufacturing techniques, together with other objects and advantages thereof, will be best understood from the following description of preferred embodiments when read with reference to the appended drawing.

The sole figure is a cross-sectional view of a dual chamber loudspeaker box in accordance with the invention.

In a housing 1 of a loudspeaker box there are provided two chambers 2; 3 which are hermetically sealed from each other. While as shown, chamber 2 is of a larger volume than chamber 3, those skilled in the art will appreciate that the chambers may be of equal size, or that their sizes may be reversed from those shown. Also, the wall dividing the housing 1 into the two chambers 2 and 3, may be disposed differently from its depicted inclination. It may be placed to divide the housing into two horizontally or vertically separated chambers, or at a different degree of inclination. The box may also be separated into more than two chambers, as when more than two loudspeakers or speaker combinations are provided.

In the outer surface 10 of a substantially vertically disposed wall of the loudspeaker box there is provided a loudspeaker 8 providing sound emission 6 in a substantially horizontal direction. A loudspeaker diffusor combination 4 consisting of a pair of loudspeakers facing each other and a double cone placed therebetween is seen to be disposed in the outer surface 7 of a substantially horizontally disposed wall of the loudspeaker box for propating sound 5 in a substantially horizontal direction. Each apex of the double cone faces one of the speakers of the diffusor combination 4. The loudspeakers are of a kind well known in the art and the diffusor 4 is understood to incorporate two speakers facing each other in a vertical direction and having between them a convex and, more particularly, a parabolic reflection surface. While the loudspeakers 4 and 8 may, as shown, be different from each other, they may also be alike, both in size as well as output volume or frequency range. The speakers will be understood to be responsive to input controls, such as balance, treble, midrange, bass or volume controls. Such controls have not, however, been shown as they are deemed to be well-known in the art. Indeed, separate or combined controls of that kind may be provided for each speaker.

During operation of the loudspeaker box sound waves emitted from the loudspeaker 8 at the front surface 10 and from the speaker diffusor combination 4 at the top surface 7 are propagated independently from each other. As clearly shown in the drawing, both loudspeakers 4 and 8 emit sound in substantially horizontal directions. However, the patterns of their sound propagation are distinct from each other. Whereas the vertically disposed speaker 8 emits sound 6 quasi in wave planes disposed normal to the direction, the diffusor 4 emits sound in a plane substantially parallel to the plane.

The advantages of the invention are, among others, that spatial or stereophonic effects may be created with one loudspeaker location and dual channel stereo input. By utilizing stereophonic input and two loudspeaker locations in a room any conventional stereo effect can be augmented by directing a definable multi-directional portion of the sound to a specific listener location. The multi-directional sound portion supplements the stereophonic effect spatially, and outside of the stereo listening location it provides for an acoustic stimulation of a natural stereophonic sound pattern, with a substantially uniform sound volume being realized in the entire room almost independently of the position of the loudspeaker. Only at the stereo listening location or between a loudspeaker and the listening location will it be exceeded.

What is claimed is:

1. A loudspeaker box, comprising:

a housing comprising at least first and second surfaces respectively disposed vertically and horizontally and forming a substantially hollow chamber;

means for dividing said chamber into at least two sections hermetically sealed from each other;

at least one first loudspeaker means in one of said sections for emitting sound in a substantially horizontal direction from said vertically disposed surface; and loudspeaker diffusor means in the other of said sections for emitting sound from said horizontally disposed surface in a substantially horizontal direction, said loudspeaker diffusor means comprising at least second and third loudspeaker means disposed to propagate sound towards each other and first and second substantially conical members disposed intermediate said second and third loudspeaker means and having apical portions respectively directed toward said second and third loudspeaker means.

2. The loudspeaker box of claim 1, wherein said sections are of different volumes.

3. The loudspeaker box of claim 1, wherein said sections are of equal volume.

4. The loudspeaker box of claim 1, wherein said first, second and third loudspeaker means are different from each other.

5. The loudspeaker box of claim 4, wherein said loudspeaker means are of different frequency ranges.

6. The loudspeaker of claim 4, wherein the number of loudspeaker means in each section is alike.

7. The loudspeaker box of claim 4, wherein the number of loudspeaker means in each section is different.

* * * * *